US005605414A

United States Patent [19]

Fuller et al.

[11] Patent Number: 5,605,414

[45] Date of Patent: Feb. 25, 1997

[54] APPARATUS AND METHOD FOR PROTECTING BARRIER

[75] Inventors: Johnny M. Fuller, 8214 Westchester, Suite 500, Dallas, Tex. 75225; Halley D. Fuller, Longview, Tex.

[73] Assignee: Johnny M. Fuller, Dallas, Tex.

[21] Appl. No.: 533,845

[22] Filed: Sep. 26, 1995

[51] Int. Cl.[6] ..... E01F 15/00

[52] U.S. Cl. ..... 404/6; 116/63 R; 40/607; 40/611

[58] Field of Search ..... 404/6, 9, 10, 72; 256/1, 19, 13.1; 52/169.14, 514; 405/216; 116/63 R, 63 P; 40/607, 611; D6/573

[56] References Cited

U.S. PATENT DOCUMENTS

| | | | |
|---|---|---|---|
| D. 10,361 | 12/1877 | Sesnon . | |
| 2,498,270 | 2/1950 | Hawley | 116/63 R |
| 3,139,731 | 7/1964 | Liddell | 405/216 |
| 3,181,300 | 5/1965 | Plummer | 405/216 |
| 3,719,049 | 3/1973 | Shaw et al. | 405/216 |
| 4,244,156 | 1/1981 | Watts, Jr. | 405/216 X |
| 4,439,071 | 3/1984 | Roper, Jr. | 405/216 |
| 4,743,142 | 5/1988 | Shiraishi et al. | 405/216 |
| 4,764,054 | 8/1988 | Sutton | 405/216 |
| 5,138,806 | 8/1992 | Marx et al. | 405/216 X |
| 5,207,175 | 5/1993 | Andonian | 116/63 R X |
| 5,299,883 | 4/1994 | Arth, Jr. | 404/10 |
| 5,435,667 | 7/1995 | Strange | 405/216 |
| 5,448,844 | 9/1995 | Miller, Jr. et al. | 40/611 |
| 5,487,618 | 1/1996 | Cox | 404/6 |

FOREIGN PATENT DOCUMENTS

| | | | |
|---|---|---|---|
| 3706552 | 9/1988 | Germany | 256/13.1 |
| 61118 | 4/1982 | Japan . | |
| 136423 | 5/1990 | Japan | 405/216 |

*Primary Examiner*—James A. Lisehora
*Attorney, Agent, or Firm*—Fulbright & Jaworski L.L.P.

[57] ABSTRACT

Apparatus and method for protecting a barrier with a resilient pad, an objective of which being to reduce damage caused by incidental contact therewith. The protector includes a resilient membrane, advantageously made of foam, incarcerated by a cover. The outside surface of the cover may also be decorated with commercial advertising to take advantage of the prominent location of barriers at gas pump islands and drive-through businesses.

35 Claims, 6 Drawing Sheets

APPARATUS AND METHOD FOR PROTECTING BARRIER

BACKGROUND OF THE INVENTION

Barriers are commonly used at gas pump islands and drive-through businesses, such as restaurants and banks, to keep automobiles a safe distance from equipment and patrons. These barriers often take the form of poles, with or without continuous horizontal cross-members, made of steel or concrete.

Unfortunately, such barriers are generally designed to give catastrophic protection and may in fact inflict minor damage to automobiles and patrons following incidental contact. For example, car doors are particularly susceptible to paint loss or dents when accidentally opened into a barrier. Similarly, patrons of a business can suffer minor abrasions or bruising by absent-mindedly brushing against a barrier.

Similarly, the barriers themselves may also deteriorate over time following repeated minor contact with vehicles. At first, marks left thereon make them unsightly, and repeated damage may ultimately require them to be replaced.

There has therefore been a long-felt but unsolved need to provide resilient protection around such barriers to reduce or even eliminate minor damage caused by incidental contact therewith.

SUMMARY OF THE INVENTION

As has been described, the present invention is directed to addressing a need for protection against damage caused by incidental contact with barriers such as are often found at gas pumps and drive-through businesses.

In providing such protection, however, new and unexpected results manifest themselves. The barriers must, of necessity, be placed prominently so as to receive attention from the passing drivers and patrons. This prominence and attention make it highly advantageous to use the exterior surface of the present invention for commercial advertising. Alternatively, bright colors and designs on the exterior surface may be used to make the barrier yet more visible to cars and patrons.

The present invention also recognizes that barrier protectors are typically installed permanently outdoors, and are thus exposed to all weather elements. Accordingly, appropriate materials may be advantageously selected to make the protector waterproof, and its outer colored designs resistant to fading from prolonged exposure to sunlight.

The present invention further recognizes that once installed on barriers, an attractively decorated protector may be susceptible to theft. Accordingly, the invention is advantageously immobilized from the barrier to which it is attached.

It is therefore a feature of the present invention to provide a resilient protector over the hard outer surface of a barrier such as is typically found near pumps at gas stations or at drive-through businesses such as restaurants and banks.

It is another feature of the invention to provide a resilient protector whose exterior may be decorated with commercial advertising or other strident marks.

It is yet another feature of the invention to provide a protector that is durable in inclement weather conditions. In particular, the invention is advantageously waterproof and resistant to fading following prolonged exposure to sunlight.

It is another further feature of the invention to provide a protector that is immobile so as to deter theft.

It is a still further feature of the invention to provide a protector that is easy and inexpensive to manufacture and install, and yet is reliable and hard wearing in use.

These and other features of the present invention will be apparent to those skilled in this art from a detailed description of at least one preferred embodiment of the invention set forth below.

BRIEF DESCRIPTION OF THE DRAWINGS

This invention will be further described in connection with the accompanying drawings, in which.

DETAILED DESCRIPTION OF THE INVENTION

Figure 1:
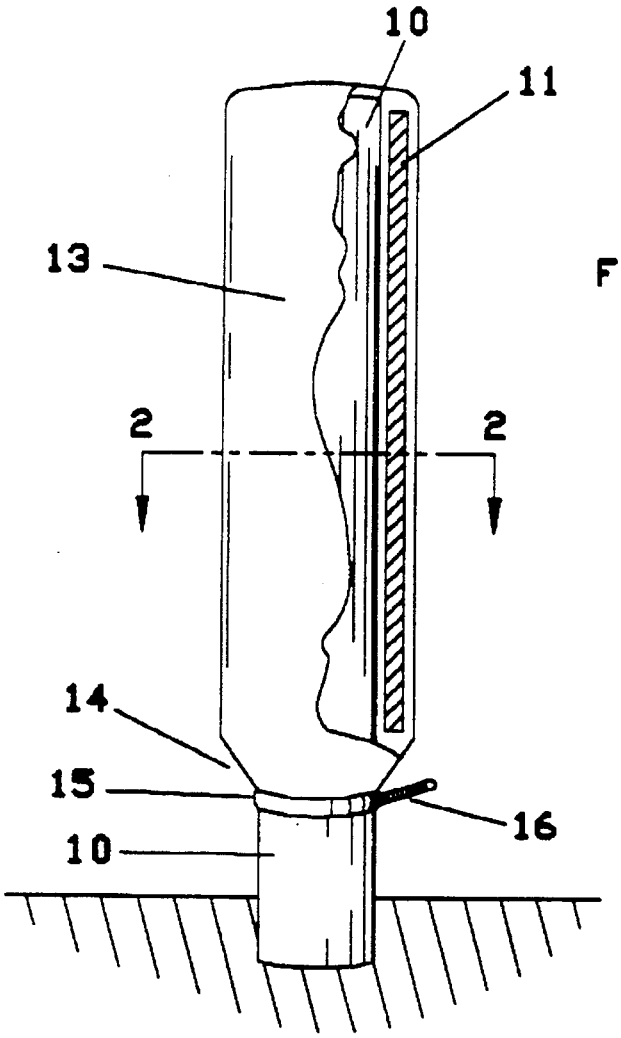
FIG. 1 is an elevation view of the present invention, illustrating components in cutaway view.
Figure 1A:
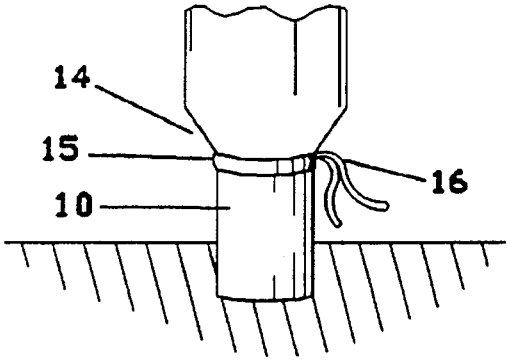
FIG. 1A is a partial elevation view of the present invention, illustrating alternative gathering means as box 16.

Referring first to FIG. 1, barrier 10 is substantially surrounded by resilient membrane 11. Cover 13 with distal end 14 incarcerates resilient membrane 11. Distal end 14 provides casing 15 formed therein. Gathering means 16 is received into casing 15. Gathering means 16 may advantageously be a cinch, as illustrated, or alternatively an elasticated contractible cuff or a drawstring as illustrated by box 16 in FIG. 1A.

Figure 2:
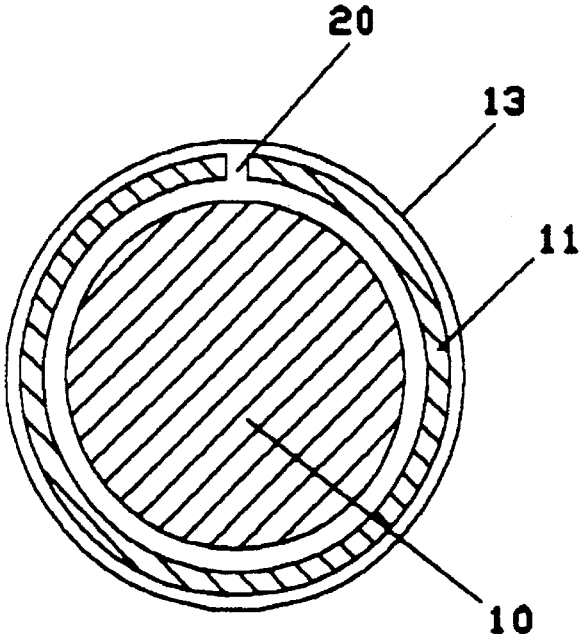
FIG. 2 is a sectional view as shown on FIG. 1. Closing seam 20 is illustrated.

Referring now to FIG. 2, and looking down on barrier 10, it will be seen that the size and shape of resilient membrane 11 are predetermined so that when resilient membrane 11 is wrapped around barrier 10, a closing seam 20 is formed. Closing seam 20 runs vertically in this embodiment down the side of barrier 10.

Figure 3A:
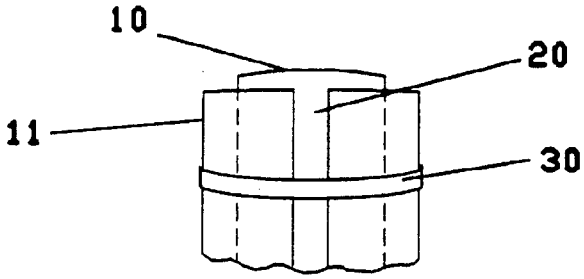
FIG. 3A is a partial elevation view of the present invention without cover 13, showing alternative fastening means as box 30.
Figure 6A:
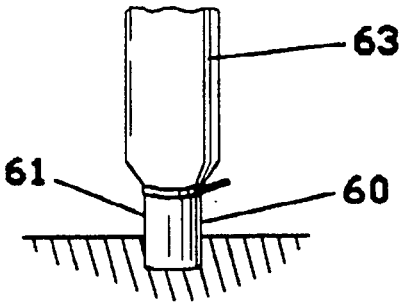
FIG. 6A is a partial elevation view of another embodiment of the present invention, showing alternative closure means as line 63.
Figure 3:
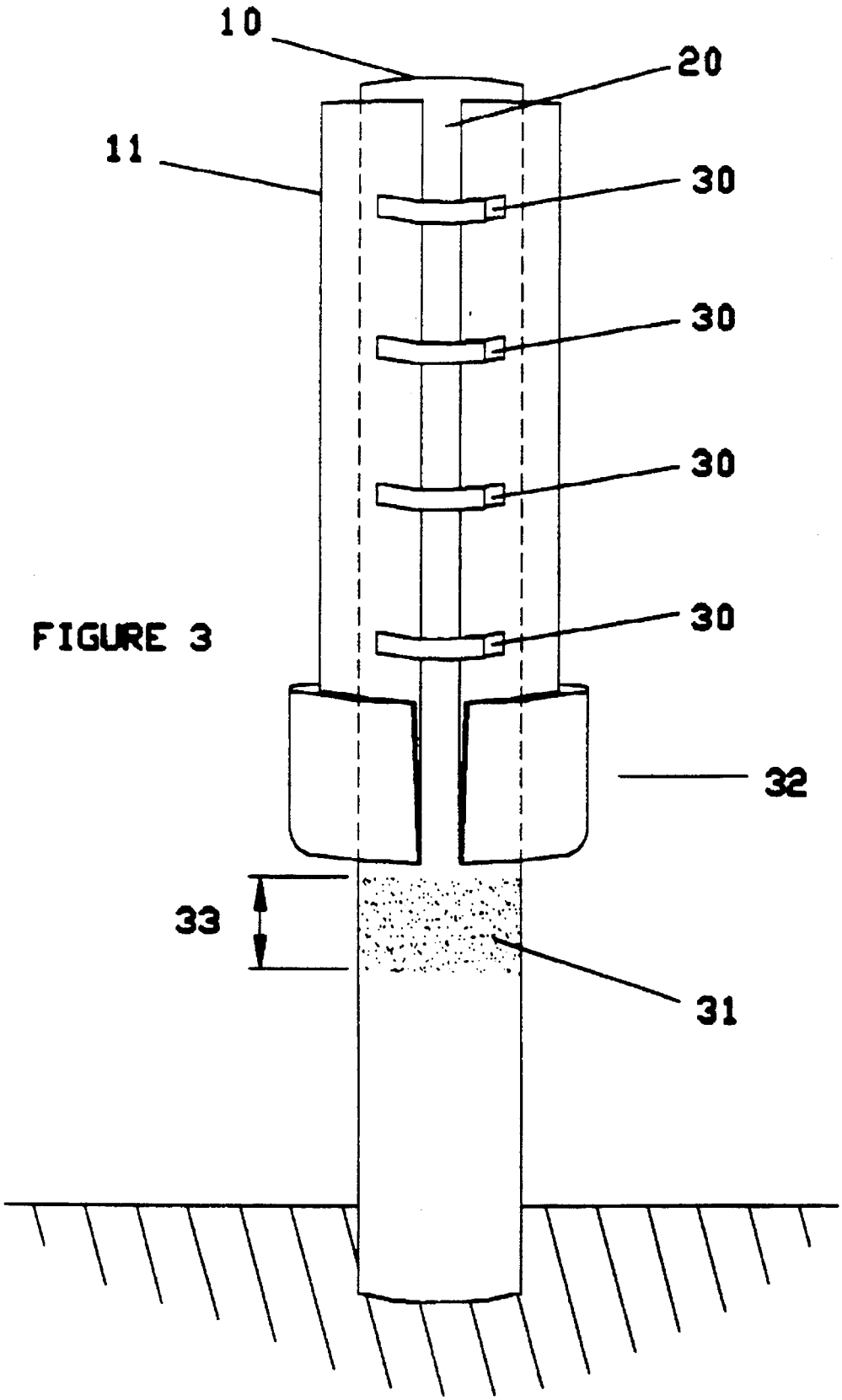
FIG. 3 is an elevation view of the present invention without cover 13, showing resilient membrane 11 prepared to be affixed to barrier 10.

FIG. 3 illustrates that closing seam 20 is held together with fastener means 30 at predetermined intervals along closing seam 20. Fastener means 30 may advantageously be a friction contact fastener, as illustrated, or alternatively self-adhesive tape, a string or an elasticated ring as illustrated by box 30 in FIG. 3A.

FIG. 3 also illustrates that resilient membrane 11 may be advantageously anchored to barrier 10 by adhesive 31. The adhesive can be "painted" or sprayed on barrier 10 at various places along its surface, or alternatively, only one spot of adhesive could be used as will be discussed. As illustrated, closing seam 20 is separated near base end 32 and resilient membrane 11 is rolled back on itself to reveal barrier anchor portion 33 of barrier 10, advantageously about 6" in length. Adhesive 31 is then applied to anchor portion 33. Resilient membrane 11 is rolled down so that the inner surface of membrane 11 makes contact with adhesive 31, and closing seam 20 is then fully restored.

Figure 4:
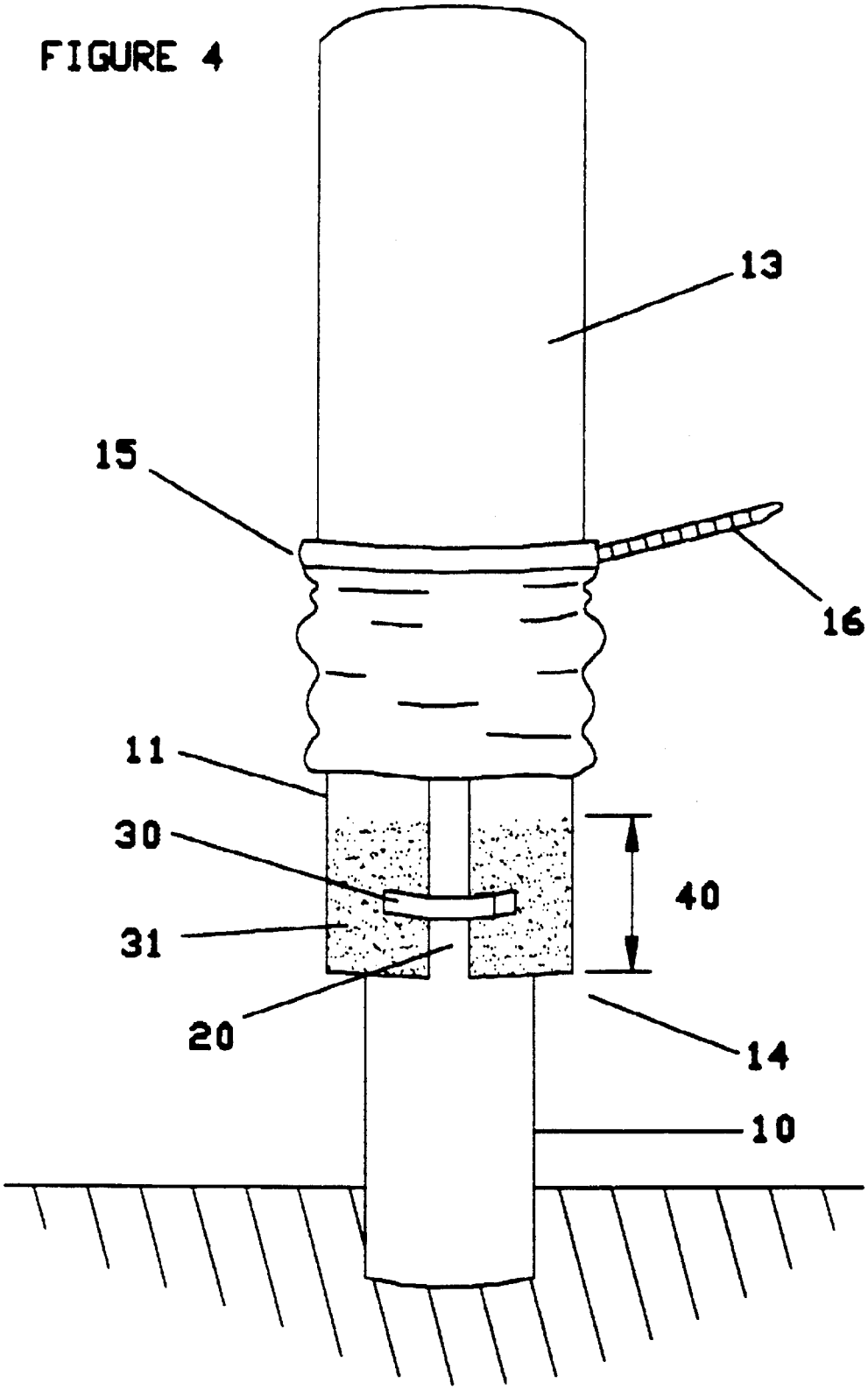
FIG. 4 is a similar elevation view of FIG. 3, this time showing cover 13 installed over resilient membrane 11, and prepared to be affixed to resilient membrane 11.

FIG. 4 similarly shows that cover 13 may also be advantageously anchored to resilient membrane 11 by adhesive 31. Again, cover 13 is rolled back at distal end 14, to reveal cover anchor portion 40 of resilient membrane 11, advantageously about 6" in length. Adhesive 31 is then applied to cover anchor portion 40, cover 13 is rolled all the way down to allow contact thereof with adhesive 31, and cover 13 at distal end 14 is then closed around barrier 10 by pulling gathering means 16 tight and cutting any excess gathering means 16 off. In one embodiment, gathering means 16 is an electrical cable cinch which has one-way ratchets locking at a cinch point.

With regard to materials selection, it will be understood that the present invention may be made from any suitable material that will perform in the manner described. Nonetheless, experimentation has shown that resilient membrane 11 may be advantageously made of a waterproof Ethyl Vinyl Acetate foam, approximately ½ inch thick and 4-pound density. Cover 13 may be advantageously made of a waterproof acrylic cloth. Adhesive 31 may be advantageously a spray bonding agent, such as 80 High Tack, manufactured by 3M Company.

Figure 5:
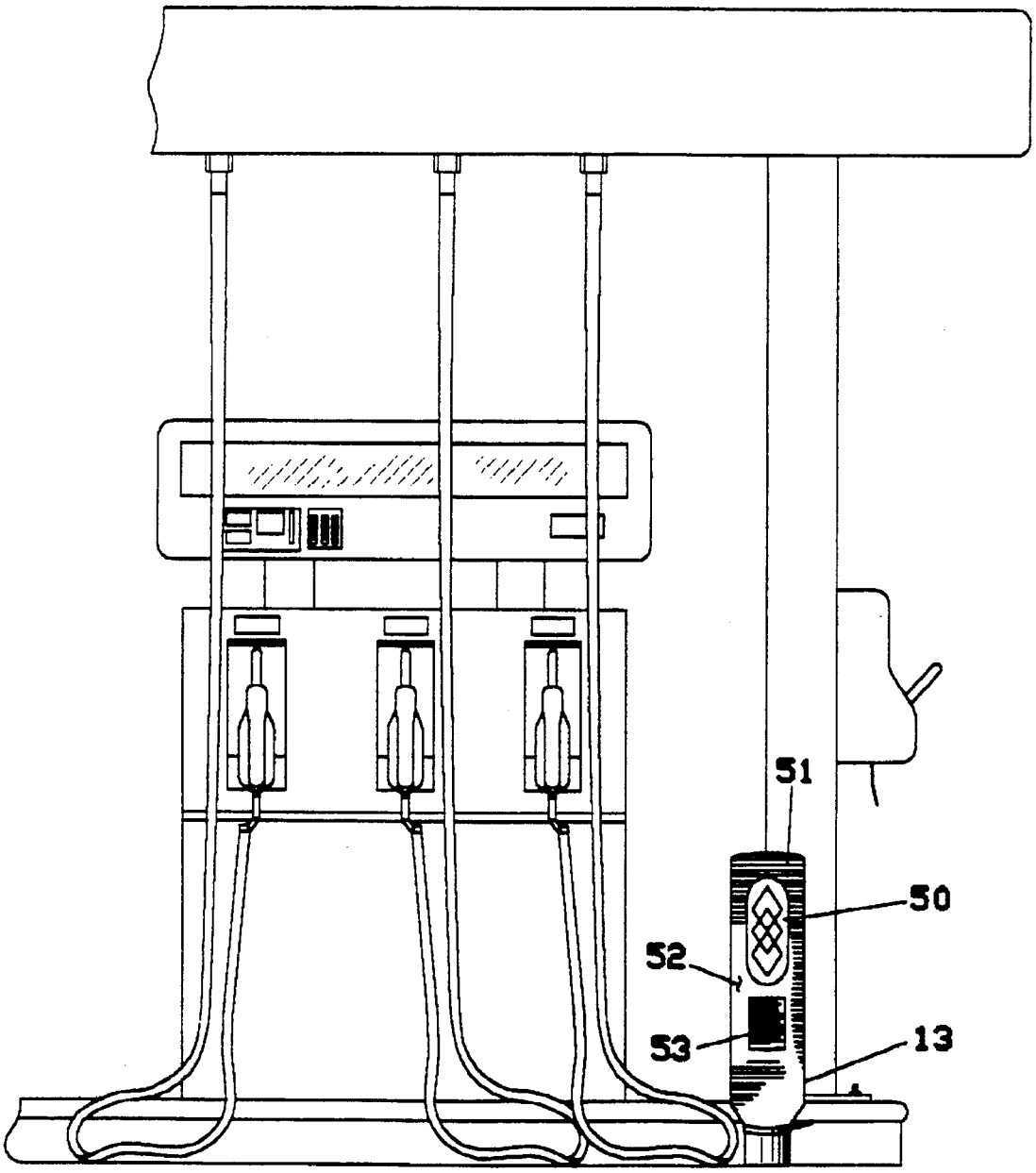
FIG. 5 is a situational view of the present invention installed on a barrier near a gas pump island, showing its advantage for commercial advertising. Optional pocket 53 is also illustrated.

FIG. 5 illustrates the present invention's utility for the communication of data, such as artwork, pictures, commercial advertising and the like. Data 50 and background coloring 51 are imprinted on outer surface 52 of cover 13, advantageously by a process such as silk-screening. The coloring media used to imprint data 50 and background coloring 51 are advantageously selected to resist fading from prolonged exposure to sunlight. Optional pocket 53 may also be provided on outer surface 52 of cover 13 in which leaflets or other similar matter may be offered.

From the foregoing description, it will be understood that installation of the present invention involves first wrapping resilient membrane 11 around barrier 10 and holding resilient membrane 11 in position with fastener means 30 over closing seam 20. Resilient membrane 11 may then be temporarily rolled back on itself at base end 32 to permit adhesive 31 to be applied between barrier 10 and resilient membrane 11.

Cover 13 is then brought over resilient membrane 11 to incarcerate same. Cover 13 may then be temporarily rolled back on itself at distal end 14 to permit adhesive 31 to be applied between resilient membrane 11 and cover 13. Distal end 14 of cover 13 is then closed around barrier 10 by pulling gathering means 16 tight and cutting any excess off.

Figure 6:
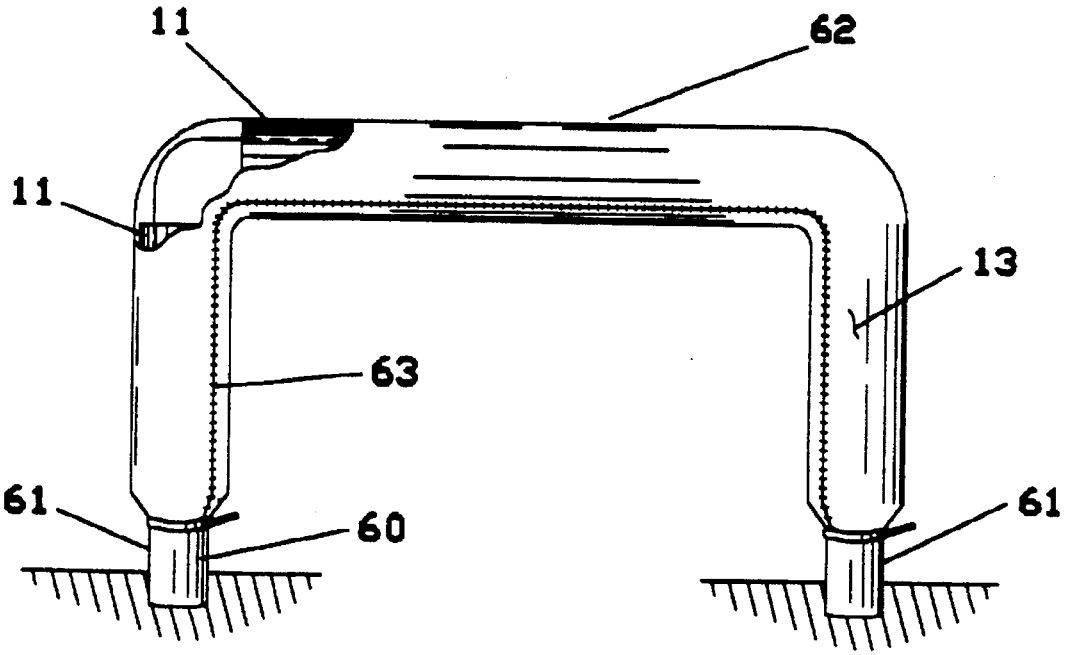
FIG. 6 is an elevational view of another embodiment of the present invention, installed on a barrier with continuous horizontal cross-member 62. Again, a cutaway view shows hidden components.

FIG. 6 illustrates an alternative embodiment of the present invention affording protection as described above to barriers with continuous horizontal cross-members. Barrier 60 has uprights 61 and continuous cross-member 62. Cover 13 in this mode is closed around uprights 61 and cross-member 62 with closure means 63 along its length. Closure means 63 may be advantageously a zipper, as illustrated, or alternatively a friction contact fastener as illustrated by line 63 in FIG. 3A.

The invention has been shown, described and illustrated in substantial detail with reference to at least one presently preferred embodiment. It will be understood by those skilled in the art, however, that changes and modifications may be made without departing from the spirit and scope of the invention which is further defined by the claims set forth hereunder.

I claim:

1. In combination with a barrier, a barrier protector, comprising:

a resilient membrane, the resilient membrane being of a predetermined shape and size to surround the barrier when wrapped around the barrier;

a closing seam, the closing seam formed in the resilient membrane when the resilient membrane is wrapped around the barrier;

at least one friction contact fastener disposed about the closing seam to hold the closing seam together;

a cover, the cover being of a predetermined shape and size to incarcerate the resilient membrane, the cover also outwardly displaying data to be communicated, said data being applied to the cover using non-fade coloring media;

the cover also having an outer surface, the outer surface providing a pocket;

the cover also having a distal end, the distal end of the cover having a casing formed therein;

a cinch, the cinch received within the casing; and adhesive means, the adhesive means applied between the resilient membrane and the barrier to affix the resilient membrane to the barrier, the adhesive means also applied between the cover and the resilient membrane to affix the cover to the resilient membrane.

2. The barrier protector of claim 1, wherein the cover also includes a closure means to enable incarceration of the resilient membrane.

3. The barrier protector of claim 2, wherein the closure means includes a zipper.

4. The barrier protector of claim 2, wherein the closure means includes a friction contact fastener.

5. In combination with a barrier, a barrier protector, comprising:

a resilient membrane, the resilient membrane being of a predetermined shape and size to surround the barrier when wrapped around the barrier;

a cover, the cover being of a predetermined shape and size to incarcerate the resilient membrane; and the cover having at least one anchor end, each anchor end providing a contractible cuff, each contractible cuff disposed to substantially permanently anchor its respective anchor end to the barrier once the cover has incarcerated the resilient membrane.

6. The barrier protector of claim 5, further comprising:

a closing seam, the closing seam formed in the resilient membrane when the resilient membrane is wrapped around the barrier; and means for holding the closing seam together.

7. The barrier protector of claim 6, wherein the means for holding the closing seam together includes a friction contact fastener.

8. The barrier protector of claim 6, wherein the means for holding the closing seam together includes self-adhesive tape.

9. The barrier protector of claim 6, wherein the means for holding the closing seam together includes an elasticated ring.

10. The barrier protector of claim 6, wherein the means for holding the closing seam together includes a string.

11. The barrier protector of claim 5, further comprising:

adhesive means, the adhesive means applied between the resilient membrane and the barrier to affix the resilient membrane to the barrier.

12. The barrier protector of claim 5, further comprising:

adhesive means, the adhesive means applied between the cover and the resilient membrane to affix the cover to the resilient membrane.

13. The barrier protector of claim 5, wherein the cover also has an outer surface, said outer surface providing a pocket.

14. The barrier protector of claim 5, wherein the resilient membrane is made of a waterproof material.

15. The barrier protector of claim 5, wherein the cover is made of a waterproof material.

16. The barrier protector of claim 5, wherein the cover also outwardly displays data to be communicated.

17. The barrier protector of claim 16, wherein the data is applied to the cover using non-fade coloring media.

18. The barrier protector of claim 5, wherein each contractible cuff further comprises:

a casing formed in the anchor end of the cover, and a gathering means received within the casing.

19. The barrier protector of claim 18, wherein the gathering means includes a cinch.

20. The barrier protector of claim 18, wherein the gathering means includes an elasticated ring.

21. The barrier protector of claim 18, wherein the gathering means includes a drawstring.

22. The barrier protector of claim 5, wherein the cover also includes a closure means to enable incarceration of the resilient membrane.

23. The barrier protector of claim 22, wherein the closure means includes a zipper.

24. The barrier protector of claim 22, wherein the closure means includes a friction contact fastener.

25. In combination with a barrier, a method of protecting said barrier, comprising the steps of:

providing a waterproof resilient membrane and a waterproof cover;

identifying a distal end to the waterproof cover, the distal end providing a contractible cuff therein;

decorating the waterproof cover with an outer appearance of predetermined colors and designs;

applying said predetermined colors and designs to the waterproof cover with non-fade coloring media;

wrapping the waterproof resilient membrane around the barrier;

immobilizing the waterproof resilient membrane;

incarcerating the waterproof resilient membrane with the waterproof cover;

immobilizing the waterproof cover; and contracting said contractible cuff tight once the waterproof cover has incarcerated the waterproof resilient membrane.

26. In combination with a barrier, a method of protecting said barrier, comprising the steps of:

wrapping a resilient membrane around the barrier;

incarcerating the resilient membrane with a cover, the cover having at least one anchor end;

providing each of said anchor ends with a contractible cuff; and substantially permanently anchoring each anchor end to the barrier by contracting each of said contractible cuffs tight once the cover has incarcerated the resilient membrane.

27. The method of protecting a barrier of claim 26, further comprising the step of immobilizing the resilient membrane.

28. The method of protecting a barrier of claim 27 wherein said membrane immobilization step includes the step of applying adhesive to the barrier at predetermined points on the barrier.

29. The method of protecting a barrier of claim 26, further comprising the step of immobilizing the cover.

30. The method of protecting a barrier of claim 29 wherein said cover immobilization step includes the step of cinching a anchor end of the cover tight against the barrier.

31. The method of protecting a barrier of claim 29 wherein said cover immobilization step further includes the step of applying adhesive to the barrier in at least one spot under the anchor end of the cover.

32. The method of protecting a barrier of claim 26, further comprising the step of initially selecting a waterproof material for use as the resilient membrane.

33. The method of protecting a barrier of claim 26, further comprising the step of initially selecting a waterproof material for use as the cover.

34. The method of protecting a barrier of claim 26, further comprising the step of initially decorating the cover with an outer appearance of predetermined colors and designs.

35. The method of protecting a barrier of claim 34, further comprising the step of applying said predetermined colors and designs to the cover with non-fade coloring media.

* * * * *